US006016091A

United States Patent [19]

Hidaka et al.

[11] Patent Number: 6,016,091

[45] Date of Patent: Jan. 18, 2000

[54] DIELECTRIC RESONATOR DEVICE COMPRISING A DIELECTRIC RESONATOR AND THIN FILM ELECTRODE LAYERS FORMED THEREON

[75] Inventors: Seiji Hidaka, Nagaokakyo; Norifumi Matsui, Kyoto; Kazuhiko Kubota, Muko; Tomoyuki Ise, Nagaokakyo, all of Japan

[73] Assignee: Murata Manufacturing Co., Ltd., Japan

[21] Appl. No.: 08/987,273

[22] Filed: Dec. 9, 1997

[30] Foreign Application Priority Data

Dec. 11, 1996 [JP] Japan ..... 8-331316
Aug. 22, 1997 [JP] Japan ..... 9-226183

[51] Int. Cl.[7] ..... H01P 7/10

[52] U.S. Cl. ..... 333/202; 333/219.1

[58] Field of Search ..... 333/202, 219.1, 333/219, 208

[56] References Cited

U.S. PATENT DOCUMENTS 4,613,838 9/1986 Wada et al. ..... 333/232
4,639,699 1/1987 Nishikawa et al. ..... 333/219.1
5,712,605 1/1998 Flory et al. ..... 333/219.1

FOREIGN PATENT DOCUMENTS 0716468 6/1996 European Pat. Off. .
63-2666903 11/1988 Japan ..... 333/219.1
4-287502 10/1992 Japan ..... 333/202

OTHER PUBLICATIONS

European Search Report dated Mar. 24, 1998.

*Primary Examiner*—Seungsook Ham
*Attorney, Agent, or Firm*—Ostrolenk, Faber, Gerb & Soffen, LLP

[57] ABSTRACT

A dielectric resonator device has a dielectric member. Electrodes are respectively formed on the upper and lower surfaces of the dielectric member. The dielectric resonator device resonates at a mode having electric field components in a direction perpendicular to the upper and lower surface of the dielectric member. The electrodes formed on the dielectric member are each formed of a thin film multi layered electrode produced by alternately laminating thin film electrode layers and thin film dielectric layers. Each thin film dielectric layer which is sandwiched between the thin film multi layered electrode layers serves as a dielectric resonator. Accordingly, the thin film multi layered electrode acts as a laminated structure of a plurality of dielectric resonators. Thus, a current distributes over the plurality of thin film electrode layers, thereby alleviating the current concentration on the surface of the dielectric member. As a consequence, conduction losses of the overall resonator unit are reduced.

15 Claims, 11 Drawing Sheets

DIELECTRIC RESONATOR DEVICE COMPRISING A DIELECTRIC RESONATOR AND THIN FILM ELECTRODE LAYERS FORMED THEREON

BACKGROUND OF THE INVENTION

1. Field of the Invention

The present invention broadly relates to dielectric resonator devices and, more particularly, to dielectric resonator devices used in a millimetric wave or microwave band.

2. Description of the Related Art

Hitherto, as comparatively high power microwave band dielectric resonators, TE01* mode dielectric resonators and TE mode dielectric resonators are used. In the TE01* mode dielectric resonators, a cylindrical or tubular dielectric member is disposed inside a shielding case. In the dielectric TM mode dielectric resonators, an electrode is disposed on the surface of a dielectric plate or a dielectric member. In particular, since the TE mode dielectric resonators are compact and obtain a high nonloaded Q ($Q_o$) factor, they are used in, for example, antenna sharing units of a base station in a mobile communication cellular system.

In the TM mode dielectric resonators, a displacement current flows along the electric field distribution, while a current flows in the electrode formed on the surface of the resonator. Thus, the $Q_o$ factor of the resonator is lowered due to conduction losses of the electrode. Accordingly, when a dielectric resonator is miniaturized using a dielectric material having a high relative dielectric constant, the current density of the surface of the resonator increases, thereby lowering the resonator $Q_o$ factor. Namely, the miniaturization of the dielectric resonator and the increased $Q_o$ factor have a trade off relationship.

SUMMARY OF THE INVENTION

Accordingly, it is an object of the present invention to provide a miniaturized dielectric resonator while maintaining a high level of the $Q_o$ factor.

To achieve the above object, according to one aspect of the present invention, there is provided a dielectric resonator device comprising: a first dielectric resonator; a first thin film electrode layer formed on a surface of the dielectric resonator; a dielectric layer formed on the first thin film electrode layer; a second thin film electrode layer formed on the dielectric layer; and a third thin film electrode layer for short circuiting the first thin film electrode layer and the second thin film electrode layer, the first and second electrode layers being short circuited at their end portions.

Since the thin film electrode layers are short circuited at their end faces, each of the dielectric layers formed on the dielectric resonator device serves as a dielectric resonator. Thus, the dielectric resonator device has a plurality of laminated dielectric resonators. A current flows while distributing from the surface of the resonator unit to the individual electrode layers, thereby reducing conduction losses.

In the foregoing dielectric resonator device, the thickness of each thin film electrode layer may be substantially equal to or smaller than the skin depth of the resonant frequency of the dielectric resonator device. By using the thin electrode layers, the dielectric resonators are electromagnetically coupled to each other, thereby distributing the current over the individual electrode layers.

Further, the resonant frequencies of the respective dielectric resonators may be equal to each other. Then, the current flowing in each thin film electrode layer can be in phase with the current flowing on the surface of the dielectric resonator device, thereby decreasing the current density in each thin film electrode layer. As a consequence, conduction losses of the dielectric resonator device can be reduced.

According to another aspect of the present invention, there is provided a dielectric filter comprising a plurality of electromagnetically coupled dielectric resonators. Each dielectric resonator has on a surface at least one dielectric layer and at least one pair of electrode layers which sandwich the dielectric layer therebetween. Since a thin film electrode is formed on part of the surface of the dielectric resonator device, a dielectric filter having reduced conduction losses can be achieved.

Further objects, features and advantages of the present invention will become apparent from the following description of the preferred embodiments with reference to the attached drawings.

DESCRIPTION OF THE PREFERRED EMBODIMENTS

The configuration of a dielectric resonator device according to a first embodiment of the present invention will now be explained with reference to FIGS. 1 through 5.

Figure 1A:
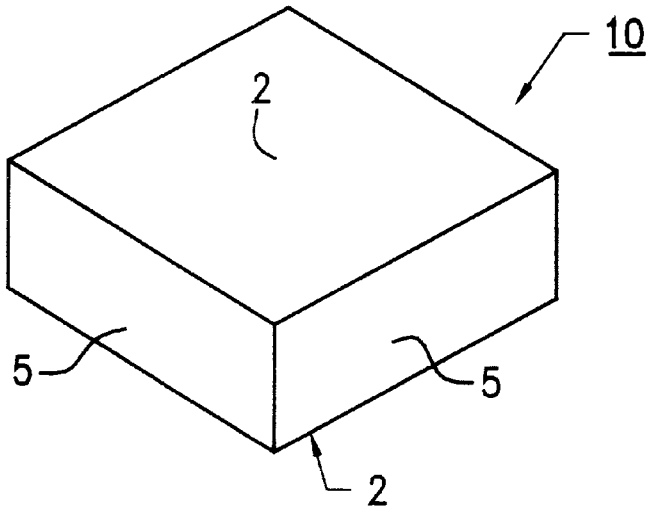
FIGS. 1A and 1B are respectively an external perspective view and a sectional view illustrating a dielectric resonator device according to a first embodiment of the present invention.
Figure 1B:
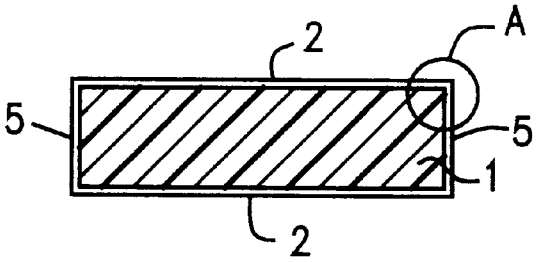

FIGS. 1A and 1B are respectively a perspective view and a sectional view illustrating a dielectric resonator device according to the first embodiment of the present invention. A dielectric resonator device generally indicated by 10 has a dielectric member 1. Thin film multi layered electrodes 2 are formed on the upper and lower surfaces of the dielectric member 1, while single layered electrodes 5 are disposed on the lateral surfaces of the dielectric member 1.

Figure 2:
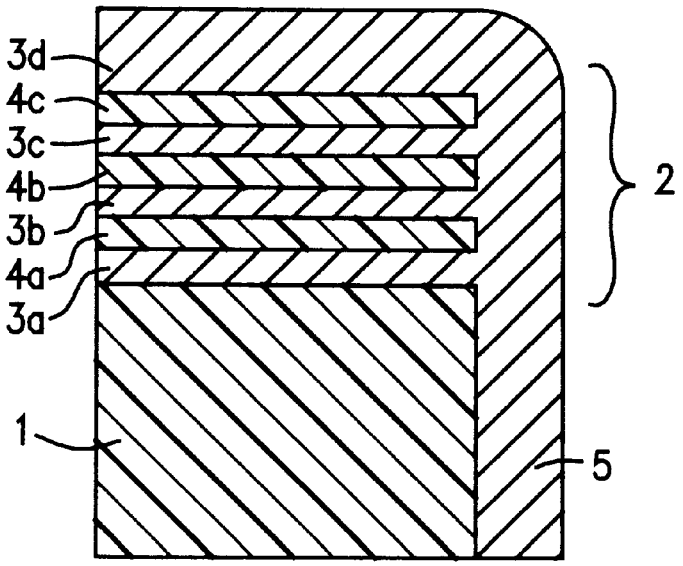
FIG. 2 is an enlarged sectional view of part of the dielectric resonator device shown in FIGS. 1A and 1B.

FIG. 2 is an enlarged sectional view of the portion A of the dielectric resonator shown in FIG. 1B. Thin film electrode layers 3*a,* 3*b,* 3*c* and 3*d* and thin film dielectric layers 4*a,* 4*b* and 4*c* are alternately laminated to form the thin film multi layered electrode 2. The number of the thin film electrode layers 3 and the thin film dielectric layers 4 is not restricted to the number of the layers shown in FIG. 2.

The thin film multi layered electrode 2 may be produced by repeating the following process. A thin film electrode layer 3 is first formed by sputtering Cu, and then, a thin film dielectric layer 4 is formed by sputtering a material having a dielectric constant lower than the dielectric member 1. An adhesive layer made from Ti or Cr may intervene between the electrode layers 3 and the dielectric layers 4 in order to consolidate the adhesiveness therebetween. After the thin film multi layered electrode 2 is formed, the single layered electrodes 5 are formed by Cu plating the lateral surface of the dielectric member 1. As a consequence, the peripheral portions of the thin film multi layered electrode 2 can be short circuited. Although the amount of Cu to be plated for which the thin film multi layered electrode 2 can be short circuited is sufficient, the plated Cu film may be extended on the uppermost layer of the multi layered electrode 2. To mass produce the above described dielectric resonator devices, the thin film multi layered electrodes 2 may be formed on a dielectric motherboard by the above method, and the motherboard may be divided into the individual dielectric resonator devices. Then, the single layered electrodes 5 may be formed by Cu plating the lateral surfaces of each resonator.

Figure 3A:
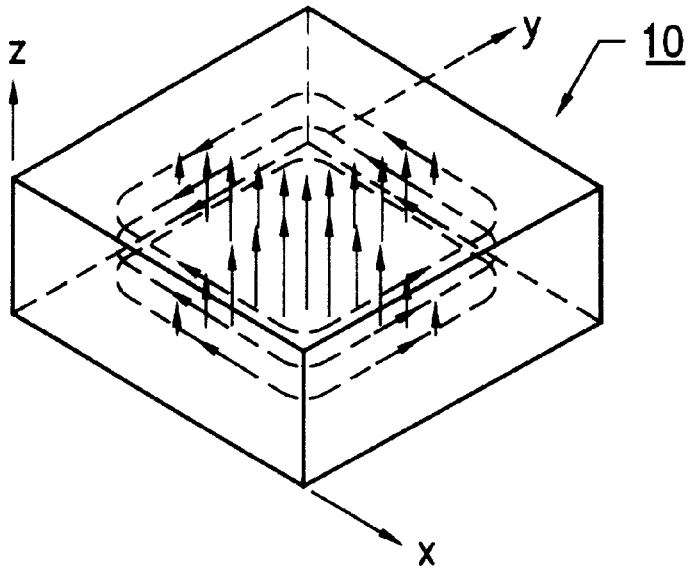
FIG. 3A illustrates the electromagnetic field distribution of the dielectric resonator device shown in FIG. 1A.
Figure 3B:
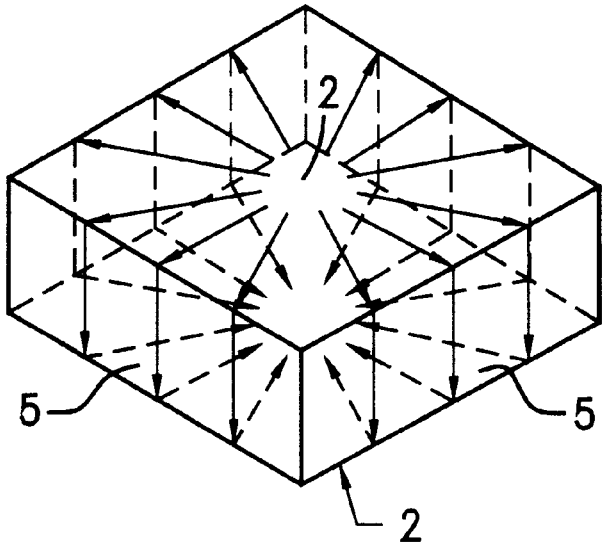
FIG. 3B illustrates the distribution of the current flowing in the electrodes of the dielectric resonator device shown in FIG. 1A.

FIG. 3A illustrates the distribution of an electromagnetic field generated within the TM110 mode dielectric resonator device shown in FIGS. 1A and 1B. FIG. 3B illustrates the distribution of the current flowing in the electrode of the TM110 mode dielectric resonator. As shown in FIG. 3A, one of the vertices of the rectangular prism shaped dielectric resonator device is determined as the origin, and the three ridges extending from the origin are determined as x, y and z axes, respectively. The electric field vector is extended along the z axis (solid line), while the magnetic field vectors are located within the x and y axes plane (dotted lines). Under the above electromagnetic distribution, the current flows in the thin film multi layered electrode 2 formed on the upper surface of the resonator unit 10 from the center of gravity to the edges of the electrode 2, while the current flows in the single layered electrode 5 from upward to downward, as shown in FIG. 3B. Further, the current flows in the thin film electrode 2 disposed on the lower surface of the resonator unit 10 from the edges to the center of gravity of the electrode 2.

Figure 4A:
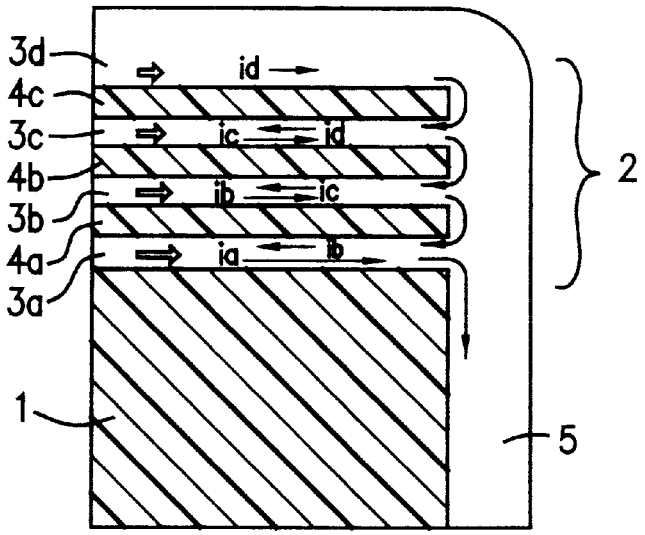
FIGS. 4A and 4B illustrate the current flowing in the thin film multi layered electrode of the dielectric resonator device shown in FIGS. 1A and 1B.
Figure 4B:
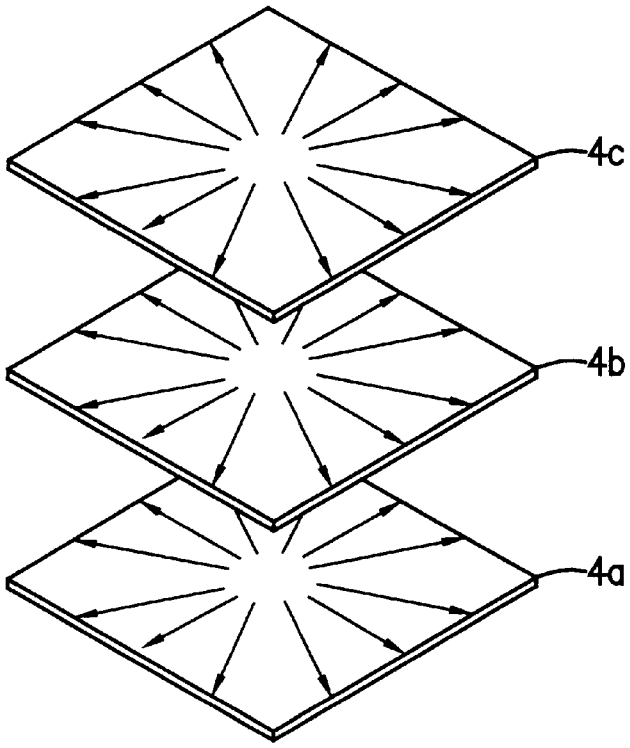

FIGS. 4A and 4B illustrate the current flowing in the thin film electrode layers 3 shown in FIG. 2. Each of the thin film dielectric layers 4*a,* 4*b* and 4*c* are alternately sandwiched between the thin film electrode layers 3*a,* 3*b,* 3*c* and 3*d,* thereby forming a very thin dielectric resonator. The resonant frequency of each resonator formed by the dielectric layer 4 is determined to be substantially equal to the resonant frequency of the overall resonator unit 10 including only the dielectric member 1. Accordingly, the currents flowing in the upper and lower electrode layers can be in phase with each other. Thus, as shown in FIG. 4A, a current ia of the dielectric resonator device 10 flows in the thin film electrode layer 3*a;* a current ib generated by the dielectric layer 4*a* flows in the electrode layers 3*a* and 3*b*; a current ic produced by the dielectric layer 4*b* flows in the electrode layers 3*b* and 3*c;* and a current id generated by the dielectric layer 4*c* flows in the electrode layers 3*c* and 3*d.* Accordingly, the combined current ia ib flows in the electrode layer 3*a;* the combined current ib ic flows in the electrode layer 3*b*; and the combined current ic id flows in the electrode layer 3*c*. The white arrows shown in FIG. 4A schematically illustrate the direction and the magnitude of the combined currents. In this manner, the current concentration on the surface of the dielectric member 1 is alleviated, and instead, the current is distributed over the electrode layers 3*a,* 3*b* and 3*c* of the resonator unit 10.

For the dielectric member 1, for example, a dielectric ceramic having a relative dielectric constant of approximately 40 is used. For the thin film electrode layers 3, a dielectric material having a relative dielectric constant lower than 40 is used. By use of the above materials, the resonant frequency of the resonators formed by the electrode layers 3 can be made substantially equal to the resonant frequency of the dielectric member 1. The thicknesses of the electrode layers 3 are determined to be equal to or smaller than the skin depth at the resonant frequency of the dielectric member 1. The electromagnetic field within the dielectric member 1 permeates the thin film electrode 2 and reaches the upper layer of the electrode 2, thereby coupling the dielectric member 1 and the dielectric layers 4*a,* 4*b* and 4*c*.

Figure 5B:
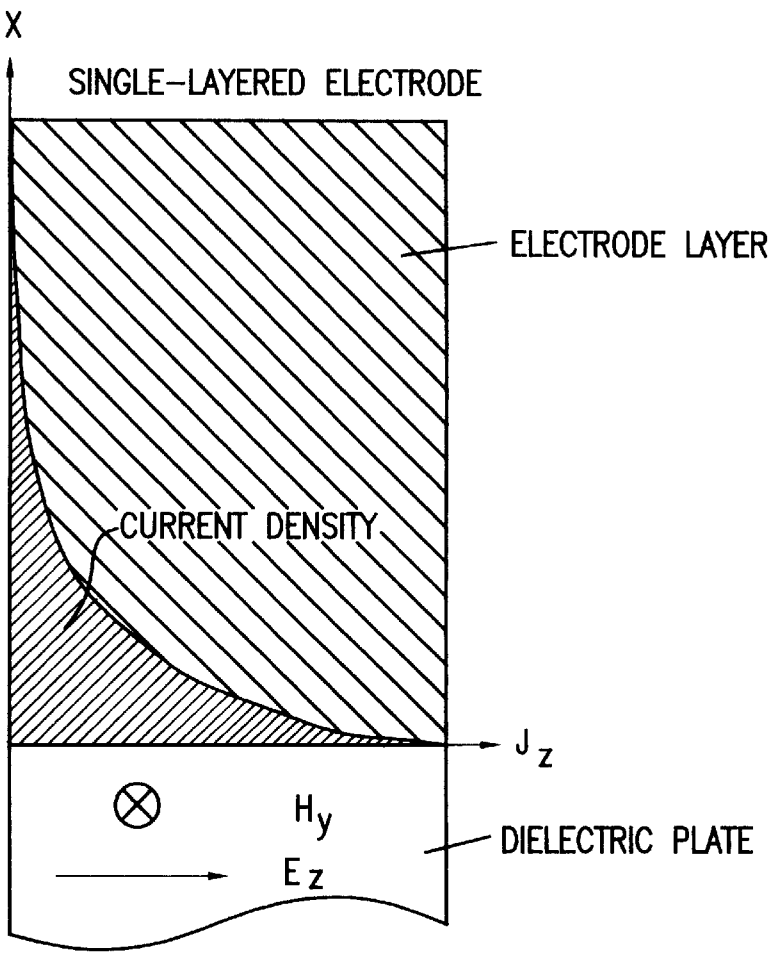
FIGS. 5A and 5B schematically illustrate the distribution of the current flowing in the thin film multi layered electrodes of the dielectric resonator device shown in FIGS. 1A and 1B.
Figure 5A:
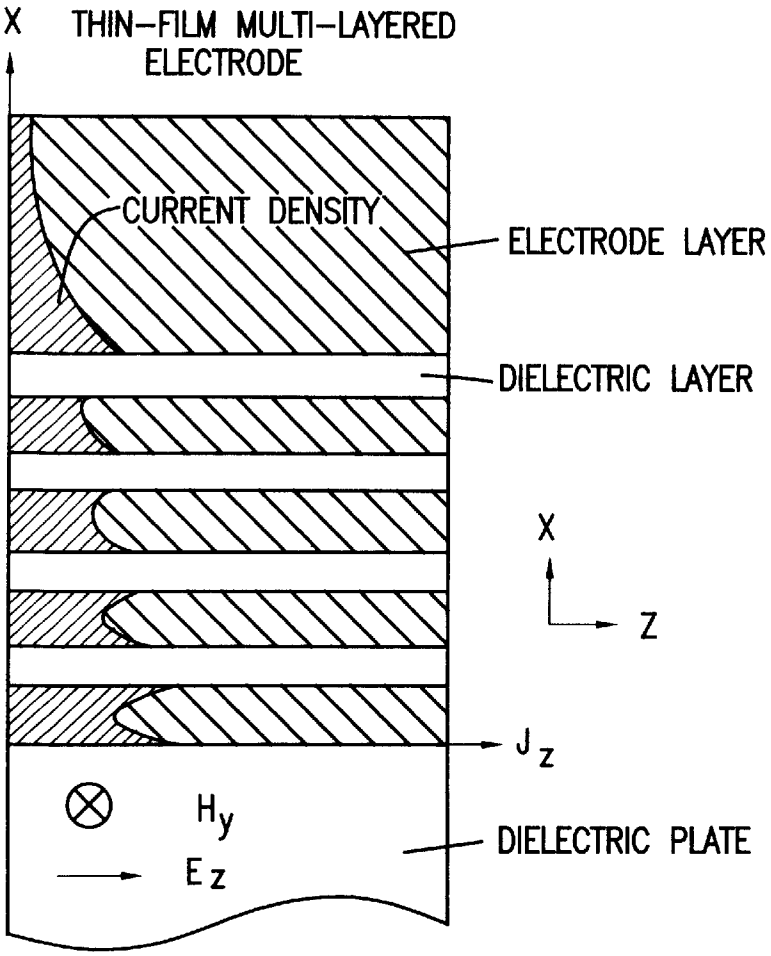

FIG. 5A illustrates the distribution of the current flowing in the thin film electrode layers 3 of the thin film electrode 2 shown in FIG. 4A. FIG. 5B illustrates the distribution of the current flowing in a single layered electrode. In FIGS. 5A and 5B, $H_y$ indicates the magnetic field along the y axis (in the perpendicular direction to the plane of the drawing); $E_Z$ represents the electric field along the z axis; and $J_Z$ indicates the current density along the z axis. When a single layered electrode is formed on the dielectric member 1, the current density exponentially decreases toward the upper surface of the electrode, and a comparatively large amount of current flows on the surface of the dielectric member 1. In contrast, according to the configuration of this embodiment, the current density is distributed, as illustrated in FIG. 5A, over the thin film electrode layer, thereby easing the concentration of the current density. A detailed explanation of a technique of designing the foregoing thin film multi layered electrode is described in the U.S. patent application Ser. No. 08/604952, and the disclosure of this patent application is incorporated herein by reference.

Examples of the improved $Q_o$ factor of the above constructed dielectric resonator are as follows. A dielectric ceramic having dimensions of 13.2 mm×13.2 mm ×3.0 mm and a relative dielectric constant ,r of 38 is used as a dielectric member, and conductor materials having a conductivity F of $5.0\times10^7$ S/m are used as the electrodes. A TM110 mode dielectric resonator device having a resonant frequency $f_o$ of 2.6 GHz is thus formed. The $Q_o$ factor of the dielectric resonator device is expressed by $1/Q_o=1/Q_{cu}+1/$ $Q_{cs}+1/Q_d$, where Q of the electrodes formed on the upper and lower dielectric member is indicated by $Q_{cs}$, Q of the electrodes formed on the lateral surfaces of the dielectric member is represented by $Q_{cs}$, and Q of the dielectric material is indicated by $Q_d$. If the electrodes formed on the respective surfaces of the dielectric member are formed of single layered electrodes, the respective elements are as follows: $Q_{cu}$=2143, $Q_{cs}$=4714, and $Q_d$=20000. Therefore, the $Q_o$ factor of the dielectric resonator device results in 1372 according to the above equation. On the other hand, if the electrodes on the upper and lower surfaces of the dielectric member are formed of thin film multi layered electrodes having five electrode layers, the respective elements are as follows: $Q_{cu}$=4286, $Q_{cs}$=4714, and $Q_d$=20000. Therefore, the $Q_o$ factor of the dielectric resonator results in 2018, which is about 1.47 times as large as $Q_o$ of the dielectric resonator using the single layered electrodes.

An explanation will now be given of the configuration of a dielectric filter formed by using dielectric resonator devices according to a second embodiment of the present invention with reference to FIGS. 6 through 8.

Figure 6A:
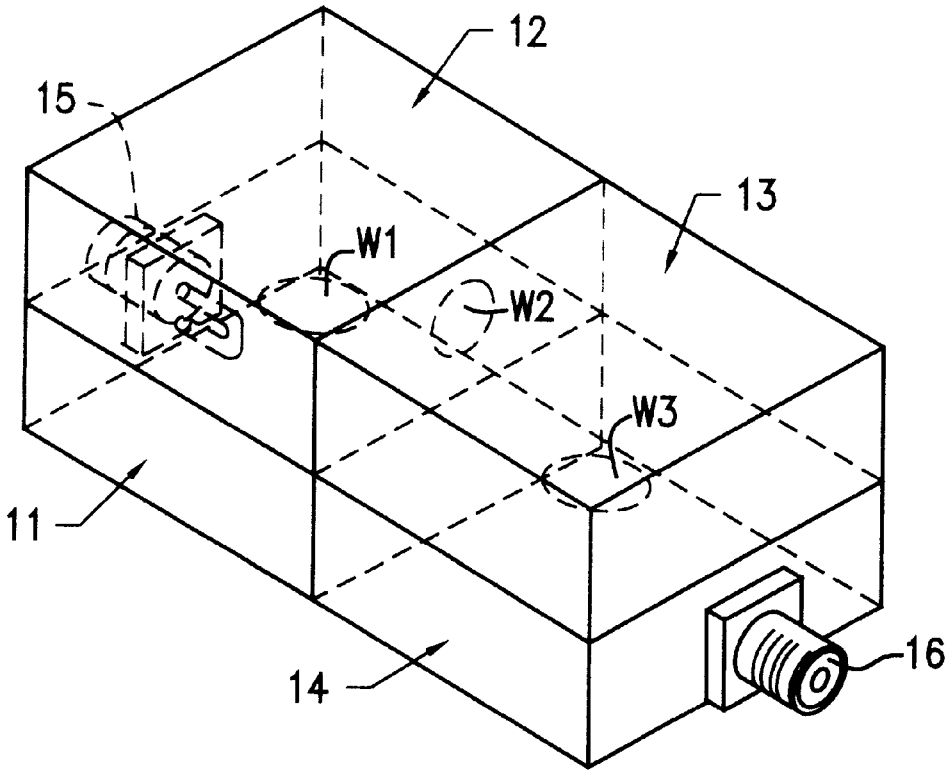
FIGS. 6A and 6B are respectively a perspective view and a sectional view in part illustrating a dielectric filter according to a second embodiment of the present invention.
Figure 6B:
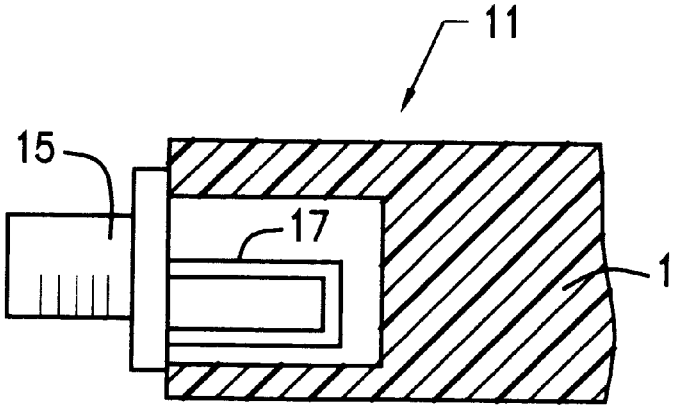

FIG. 6A is a perspective view illustrating a dielectric filter formed by combining four dielectric resonator devices; and FIG. 6B is a sectional view of part of the dielectric filter shown in FIG. 6A. Dielectric resonator devices 11, 12, 13 and 14 are fundamentally similar to the resonator unit shown in FIG. 1, except that an electrode free portion W1 is disposed on the contact surfaces between the dielectric resonator devices 11 and 12. The electrode free portion is an area where the dielectric resonator is not covered with an electrode. For example, in the electrode free portion W1, such electrode uncovered portions are provided on the upper surface of the resonator unit 11 and the lower surface of the resonator unit 12 and are aligned to each other. An electrode free portion W2 is formed on the contact surfaces between the resonator units 12 and 13. Further, an electrode free portion W3 is formed on the contact surfaces between the resonator units 13 and 14. Coaxial connectors 15 and 16 are attached to the lateral surfaces of the resonator units 11 and 14, respectively. Thin film multi layered electrodes are respectively disposed on the upper surfaces of the resonator units 12 and 13 and the lower surfaces of the resonator units 11 and 14, while single layered electrodes are formed on the surfaces provided with the electrode free portions W1 and W3. To further reduce conduction losses, thin film multi layered electrodes may be respectively provided on the lower surfaces of the resonator units 12 and 13 and on the upper surfaces of the resonator units 11 and 14. In this case, each electrode layer forms an opened end face at the electrode free portion W1 or W3; namely, the thin film electrodes are not electrically connected to each other in the electrode free portions W1 and W3. This may be achieved by partially cutting the electrodes by pattern etching.

FIG. 6B is a sectional view illustrating the mounting portion of the coaxial connector 15 formed on the lateral surface of the dielectric resonator device 11. A coupling loop 17 is formed of the center conductor of the coaxial connector 15 and is inserted into a hole provided in the dielectric member of the dielectric resonator device 11.

Figure 7A:
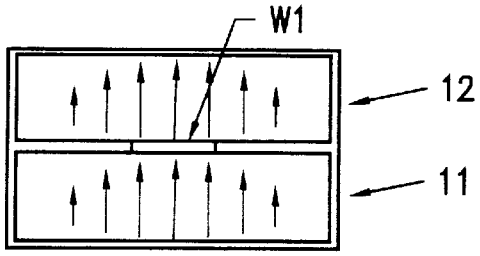
FIGS. 7A and 7B illustrate the coupling state between the vertically connected dielectric resonator devices used in the dielectric filter shown in FIGS. 6A and 6B.
Figure 7B:
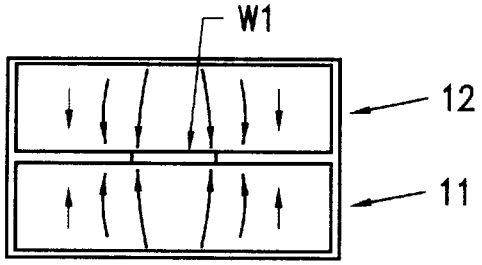

FIG. 7 is a sectional view illustrating the coupling state between the dielectric resonators 11 and shown in FIG. 6A. FIG. 7A illustrates the electric field distribution of the even mode; and FIG. 7B illustrates the electric field distribution of the odd mode. Given with the electrode free portion W1, the odd mode capacitance decreases to make the odd mode resonant frequency $f_{odd}$ higher than the even mode resonant frequency $f_{even}$, thereby electrically coupling the dielectric resonator devices 11 and 12.

Figure 8A:
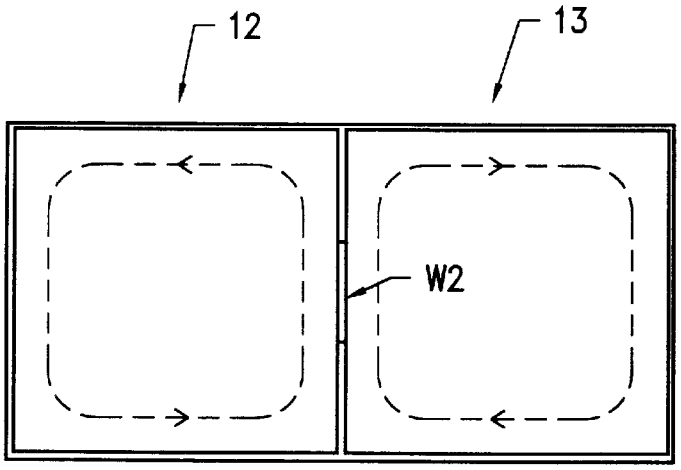
FIGS. 8A and 8B illustrate the coupling state between the horizontally connected dielectric resonator devices used in the dielectric filter shown in FIGS. 6A and 6B.
Figure 8B:
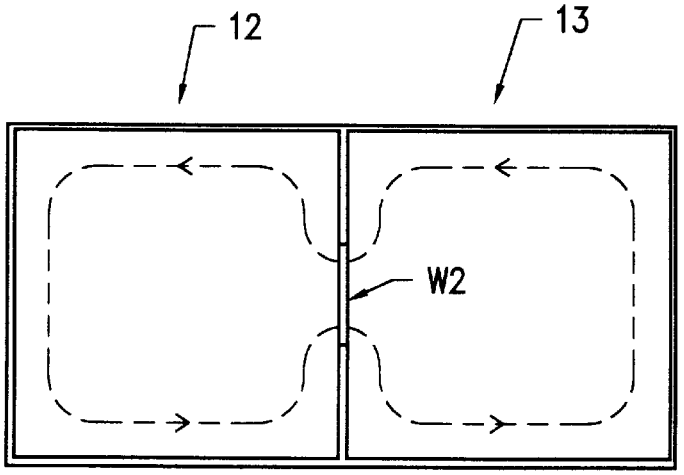

FIG. 8 illustrates the coupling state between the dielectric resonator devices 12 and 13 shown in FIG. 6. FIG. 8A illustrates the magnetic field distribution of the odd mode; and FIG. 8B illustrates the magnetic field distribution of the even mode. Given with the electrode free portion W2, the even mode resonant frequency is lowered with an increased inductance component, thereby making the odd mode resonant frequency $f_{odd}$ higher than the even mode resonant frequency $f_{even}$. Thus, the dielectric resonator devices 12 and 13 are magnetically coupled. As in the dielectric resonator devices 11 and 12, the dielectric resonator devices 13 and 14 are electrically coupled by virtue of the presence of the electrode free portion W3. In the dielectric filter shown in FIG. 6, electrical coupling or magnetic coupling is sequentially established between the coaxial connector 15, the dielectric resonator devices 11, 12, 13 and 14, and the coaxial connector 16 in the given order. Thus, a four stage resonator filter having bandpass filter characteristics is obtained.

As in the foregoing embodiment, thin film multi layered electrodes are formed on the upper and lower surfaces of each dielectric resonator device, thereby improving the $Q_o$ factor by, for example, 1.47 times as large as conventional resonators. Therefore, insertion losses of the above described bandpass filter can be reduced by, for example, 1 to 1.47 times.

Figure 9A:
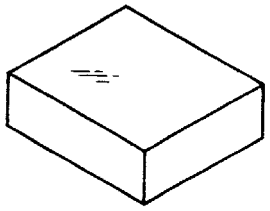
FIGS. 9A, 9B and 9C illustrate the different configurations of dielectric resonator devices according to a third embodiment of the present invention.
Figure 9B:
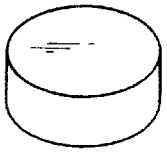
Figure 9C:
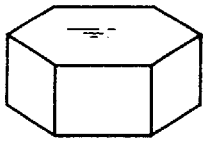

FIGS. 9A, 9B and 9C are perspective views respectively illustrating dielectric resonator devices having different configurations according to a third embodiment of the present invention. The dielectric resonator devices described in the first and second embodiments use a prism shaped dielectric plate having a square base. However, a rectangular prism shaped dielectric plate or dielectric member shown in FIG. 9A or a cylindrical dielectric plate or dielectric member shown in FIG. 9B may be employed. Alternatively, a polygonal dielectric plate or dielectric member having, for example, a polygonal base with at least five sides, illustrated in FIG. 9C may be used. Whichever configuration is used, thin film multi layered electrodes should be formed on the upper and lower surfaces of the dielectric plate.

Figure 10A:
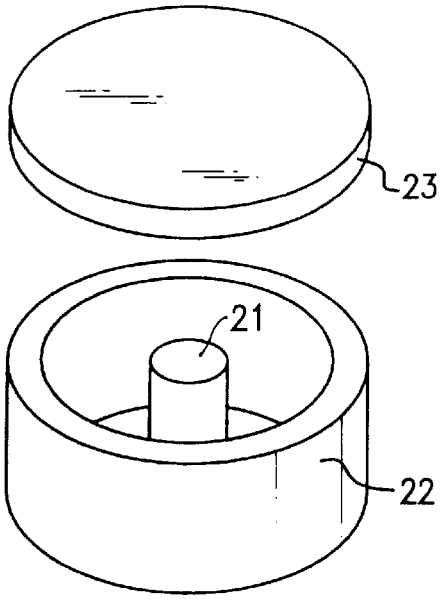
FIGS. 10A and 10B are respectively an exploded perspective view and a sectional view illustrating the structure of a dielectric resonator device according to a fourth embodiment of the present invention.
Figure 10B:
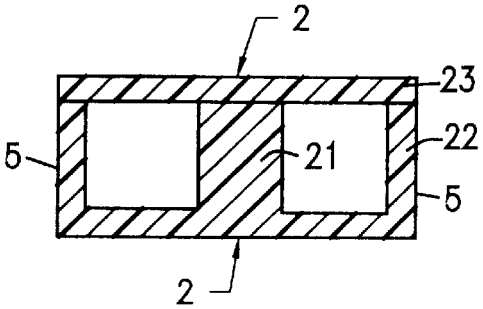

FIG. 10 illustrates the structure of a dielectric resonator device according to a fourth embodiment of the present invention. As illustrated in FIG. 10A, a cylindrical dielectric member 21 is integrally formed within a tubular cavity 22 having a bottom surface, and a disc like dielectric plate 23 is bonded to the opening of the cavity 22. Thus, a TM010 mode dielectric resonator device on the cylindrical coordinates is formed, as shown in FIG. 10B. Thin film multi layered electrodes 2 are respectively provided on the upper surface of the dielectric plate 23 and the lower surface of the cavity 22, while single layered electrodes 5 are formed on the peripheral surface of the dielectric plate 23 and the peripheral surface of the cavity 22.

Figure 11A:
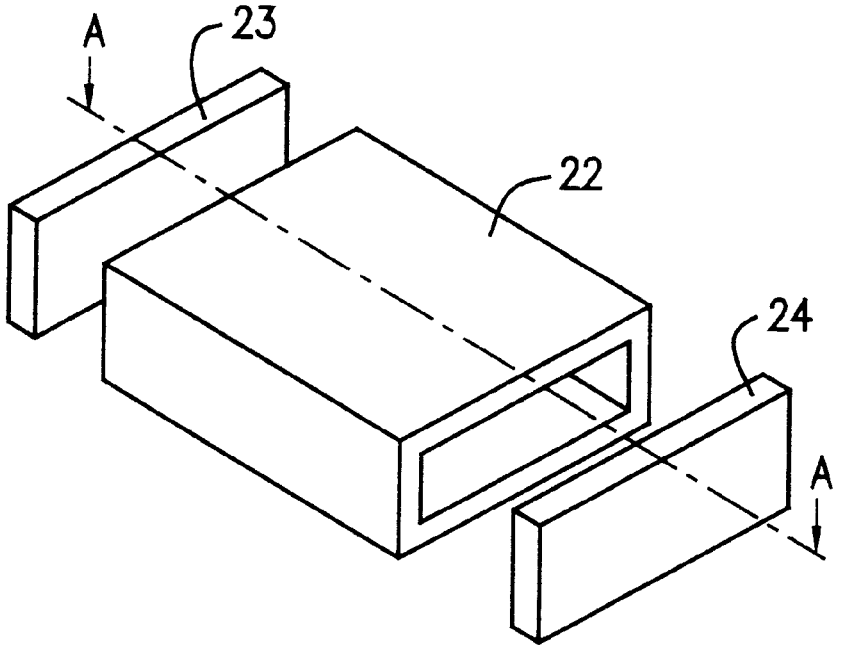
FIGS. 11A and 11B are respectively an exploded perspective view and a sectional view illustrating the structure of a dielectric resonator device according to a fifth embodiment of the present invention.
Figure 11B:
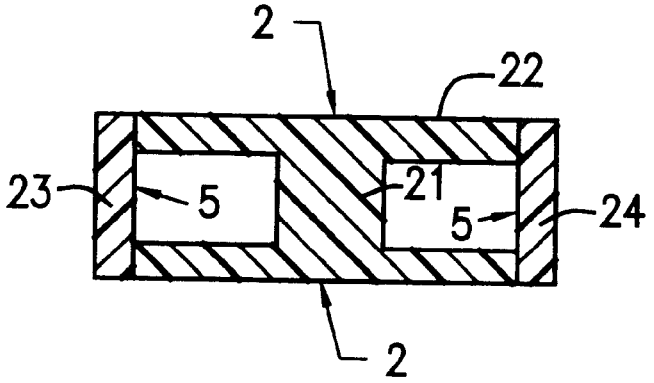

FIG. 11 illustrates the structure of a dielectric resonator device according to a fifth embodiment of the present invention. FIG. 11A is an exploded perspective view; and FIG. 11B is a sectional view along the line A A when the individual elements shown in FIG. 11A are assembled. A prism shaped dielectric member 21 is integrally formed within an angular tube like cavity 22, and dielectric plates 23 and 24 are bonded to two openings of the cavity 22. In this embodiment, thin film multi layered electrodes 2 are provided on the upper and lower surfaces of the cavity 22, while single layered electrodes 5 are formed on the inner surfaces of the dielectric plates 23 and 24.

The dielectric plates 23 and 24, which are disposed at the left and right edges of the thin film multi layered electrodes 2, as illustrated in FIG. 11B, also support electrodes for short circuiting the thin film electrodes 2. The short circuiting electrodes are produced by the following procedure. A thin electrode film is formed on each of the surfaces of the dielectric plates 23 and 24, and the plates 23 and 24 are respectively brought into contact with the openings of the cavity 22. With this arrangement, the edges of the thin film electrodes 2 are short circuited by the thin electrode film. It is preferable that the short circuiting electrodes are formed thin because a large volume of the short circuiting electrodes adversely influences the characteristics of the resonator unit.

The configuration of a dielectric filter according to a sixth embodiment of the present invention will now be described with reference to FIGS. 12 and 13.

Figure 12:
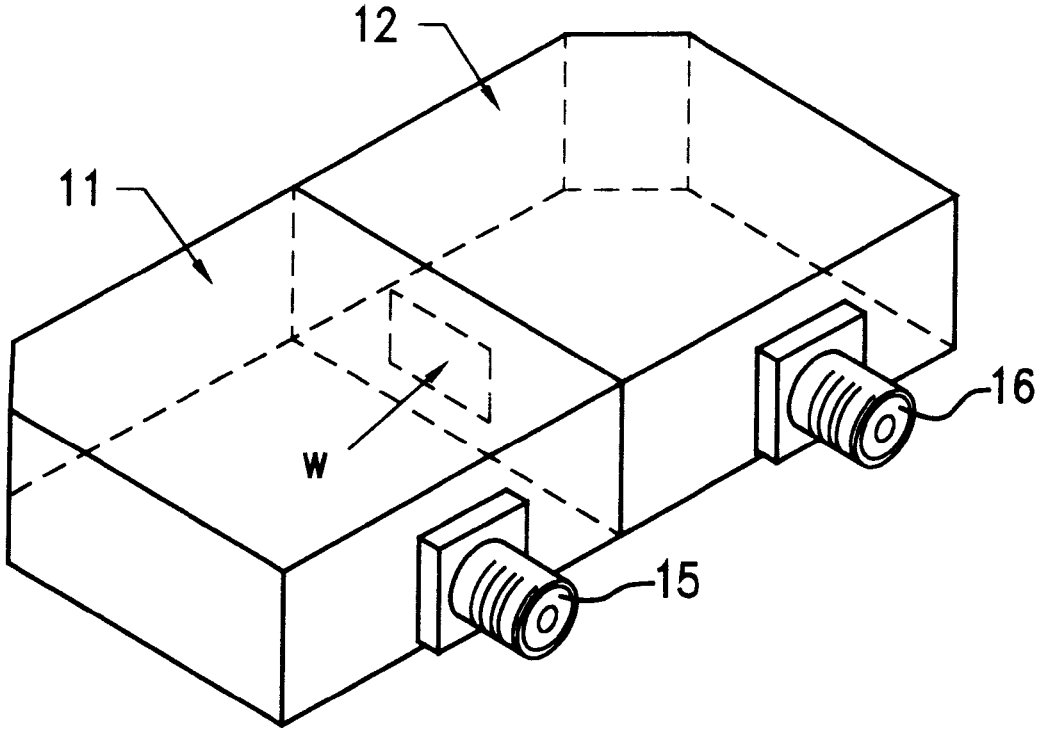
FIG. 12 is a perspective view illustrating a dielectric filter according to a sixth embodiment of the present invention.

Referring to FIG. 12, TM double mode dielectric resonator devices 11 and 12 are each formed of a dielectric plate. Thin film multi layered electrodes are formed on the upper and lower surfaces of the dielectric plate of each resonator unit, while single layered electrodes are provided on the peripheral surfaces of the dielectric plate. Further, an electrode free portion W is formed on the contact surfaces between the two resonator units. Coaxial connectors 15 and 16 having an internal coupling loop are provided side by side on the surfaces of the two resonator units in the same plane.

Figure 13A:
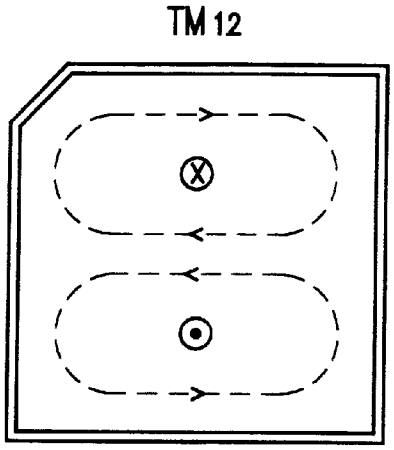
FIGS. 13A, 13B and 13C illustrate the coupling mode and the coupling state of the dielectric resonator devices of the dielectric filter shown in FIG. 12.
Figure 13B:
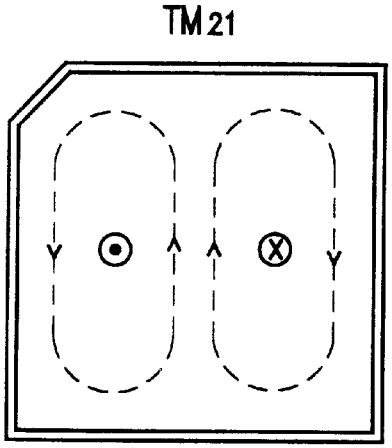
Figure 13C:
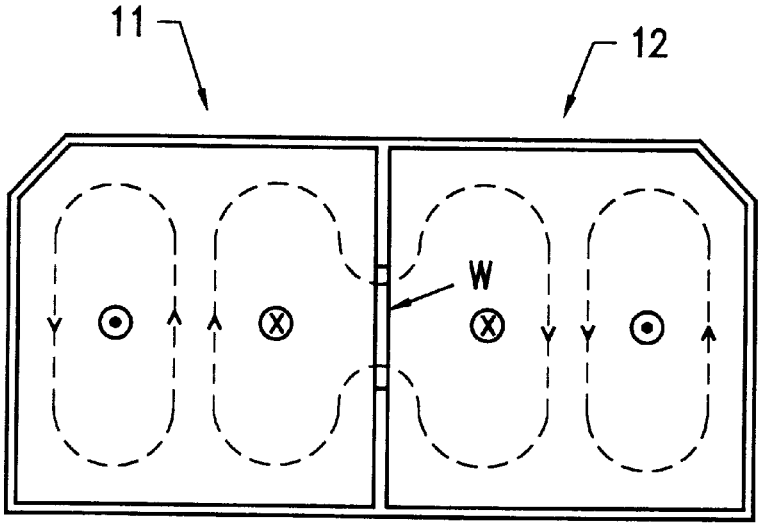

FIG. 13 illustrates the resonant mode and the coupling state of the dielectric resonator devices 11 and 12 shown in FIG. 12. The arrows indicated by the dotted lines represent the magnetic field distributions. The two resonator units 11 and 12 resonate, as shown in FIGS. 13A and 13B, in degenerative modes, such as a TM120 mode (hereinafter simply referred to as the TM12 mode and a TM210 mode (hereinafter simply referred to as the TM21 mode). The coupling loops of the coaxial connectors 15 and 16 are magnetically coupled to the TM12 mode. As is seen from the coupling state shown in FIG. 13C, due to the presence of the electrode free portion W, the dielectric resonator devices 11 and 12 are magnetically coupled to each other in the TM21 modes. Moreover, the corners of the respective dielectric plates are partially chamfered to generate a difference in the resonant frequency between the even mode of the TM21 mode and the odd mode of the TM12 mode, thereby coupling the two modes. Consequently, in the dielectric filter shown in FIG. 12, magnetic coupling is established between the coaxial connector 15, the TM12 mode of the dielectric resonator 11, the TM21 mode of the dielectric resonator 11, the TM21 mode of the dielectric resonator 12, the TM12 mode of the dielectric resonator 12, and the coaxial connector 16 in the given order. Therefore, a four stage resonator bandpass filter can be obtained.

Figure 14A:
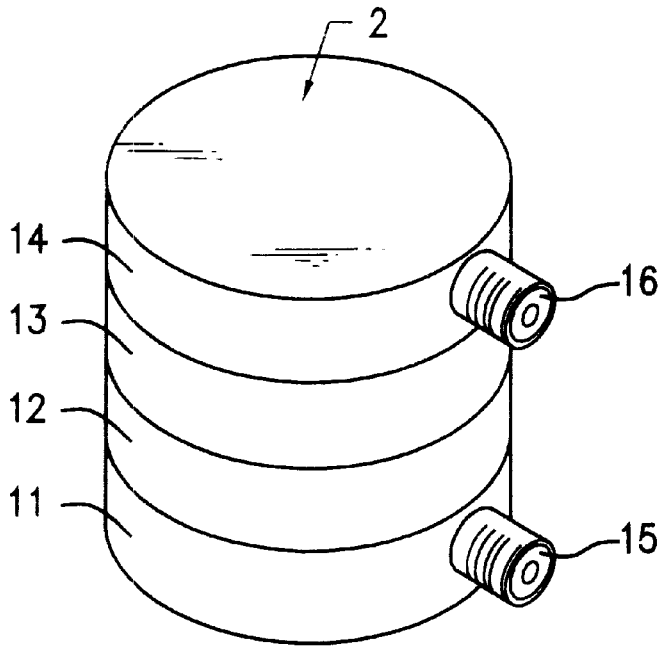
FIGS. 14A and 14B are respectively a perspective view and a sectional view illustrating the configuration of a dielectric filter according to a seventh embodiment of the present invention.
Figure 14B:
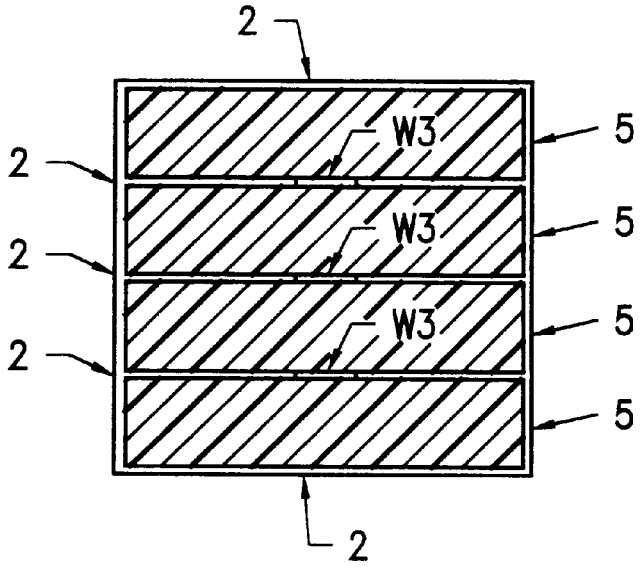

FIGS. 14A and 14B are respectively a perspective view and a sectional view of a dielectric filter according to a seventh embodiment of the present invention. The flat surfaces of a plurality of dielectric resonator devices 11, 12, 13 and 14 are bonded to each other to form a multi layered dielectric filter. Also, electrode free portions W1, W2 and W3 are formed on the contact surfaces between the respective dielectric plates to electrically couple the dielectric resonator devices 11, 12, 13 and 14, thereby fabricating a multi stage filter. In this case, all the electrodes on the flat surfaces of the dielectric plates are completely formed by thin film multi layered electrodes, and single layered electrodes are provided on the peripheral surfaces of the dielectric plates. This makes it possible to reduce conduction losses of the dielectric resonator devices, thereby obtaining a filter with less insertion losses.

What is claimed is:

1. A dielectric resonator device comprising:

a first dielectric resonator;

a first thin film electrode layer formed on a surface of said dielectric resonator;

a dielectric layer formed on said first thin film electrode layer;

a second thin film electrode layer formed on said dielectric layer; and a third thin film electrode layer for short circuiting said first thin film electrode layer and said second thin film electrode layer, said first and second electrode layers being short circuited at end portions thereof;

further comprising at least one additional dielectric layer and at least one additional thin film electrode layer laminated on said second thin film electrode layer, wherein said third thin film electrode layer short circuits said first thin film electrode layer, said second thin film electrode layer, and said at least one additional electrode layer at end portions thereof.

2. A dielectric resonator device according to claim 1, wherein the thickness of each of said first, second and third thin film electrode layers is substantially equal to or smaller than the skin depth of the resonant frequency of said first dielectric resonator.

3. A dielectric resonator device comprising:

a first dielectric resonator;

a first thin film electrode layer formed on a surface of said dielectric resonator;

a dielectric layer formed on said first thin film electrode layer;

a second thin film electrode layer formed on said dielectric layer; and a third thin film electrode layer for short circuiting said first thin film electrode layer and said second thin film electrode layer, said first and second electrode layers being short circuited at end portions thereof;

wherein said dielectric layer and said first and second thin film electrode layers form a second dielectric resonator, the resonant frequency of said second dielectric resonator being substantially equal to the resonant frequency of said first dielectric resonator.

4. A dielectric resonator device according to claim 1, wherein a fourth thin film electrode layer is formed on the surface of said first dielectric resonator opposite to the surface on which said first thin film electrode layer is formed.

5. A dielectric resonator device according to claim 4, wherein said third thin film electrode layer short circuits said first, second and fourth thin film electrode layers.

6. A dielectric filter comprising:

a first dielectric resonator having at least one dielectric layer and a pair of first and second electrode layers which sandwich said dielectric layer therebetween, a third electrode layer located for short circuiting said first and second electrode layers at end portions thereof, and a fourth electrode layer, said dielectric layer and said first and second electrode layers being formed on one surface of said first dielectric resonator, and said fourth electrode layer being formed on another surface of said first dielectric resonator;

further comprising at least one additional dielectric layer and at least one additional electrode layer laminated on said second electrode layer, wherein said third electrode layer short circuits said first electrode layer, said second electrode layer, and said at least one additional electrode layer at end portions thereof;

a second dielectric resonator having at least one dielectric layer and a pair of fifth and sixth electrode layers which sandwich said dielectric layer therebetween, a seventh electrode layer located for short circuiting said fifth and sixth electrode layers at portions thereof, and an eighth electrode layer, said dielectric layer and said fifth and sixth electrode layers being formed on one surface of said second dielectric resonator, and said eighth electrode layer being formed on another surface of said second dielectric resonator;

further comprising at least one additional dielectric layer and at least one additional electrode layer laminated on said sixth electrode layer, wherein said seventh electrode layer short circuits said fifth electrode layer, said sixth electrode layer, and said at least one additional electrode layer at end portions thereof;

an input device electromagnetically coupled to part of said first dielectric resonator;

an output device electromagnetically coupled to part of said second dielectric resonator; and an electromagnetic coupling arrangement for electromagnetically coupling said first and second dielectric resonators.

7. A dielectric filter according to claim 6, wherein said electromagnetic coupling arrangement comprises a first portion where a portion of said fourth electrode layer is removed and a second portion where a portion of said eighth electrode layer is removed, said first portion and said second portion being positioned opposite to each other.

8. A dielectric filter comprising:

a first dielectric resonator having at least one dielectric layer and a pair of first and second electrode layers which sandwich said dielectric layer therebetween, a third electrode layer located for short circuiting said first and second electrode layers at end portions thereof, and a fourth electrode layer, said dielectric layer and said first and second electrode layers being formed on one surface of said first dielectric resonator, and said fourth electrode layer being formed on another surface of said first dielectric resonator;

a second dielectric resonator having at least one dielectric layer and a pair of fifth and sixth electrode layers which sandwich said dielectric layer therebetween, a seventh electrode layer located for short circuiting said fifth and sixth electrode layers at end portions thereof, and an eighth dielectric layer, said dielectric layer and said fifth and sixth electrode layers being formed on one surface of said second dielectric resonator, and said eighth electrode layer being formed on another surface of said second dielectric resonator;

an input device electromagnetically coupled to part of said first dielectric resonator;

an output device electromagnetically coupled to part of said second dielectric resonator; and an electromagnetic coupling arrangement for electromagnetically coupling said first and second dielectric resonators;

wherein said fourth electrode layer and said eighth electrode layer each comprise a plurality of dielectric layers and a plurality of electrode layers which alternately sandwich said plurality of dielectric layers.

9. A dielectric filter according to claim 7, wherein said electrode layers comprised in said fourth and eighth electrode layers are electrically disconnected from each other at said first portion and said second portion.

10. A dielectric resonator comprising:

a hollow case at least having one opening, the outer surface of said hollow case being covered with an electrode layer;

a first dielectric member formed as a dielectric block and disposed in said case; and a second dielectric member placed on said case to cover said opening, a dielectric layer and a pair of first electrode layers which sandwich said dielectric layer therebetween being formed on the outer surface of said second dielectric member, and a second electrode layer for short circuiting said first electrode layers at end portions thereof being further formed on the outer surface of said second dielectric member;

further comprising at least one additional dielectric layer and at least one additional first electrode layer laminated on said pair of first electrode layers, wherein said second thin film electrode layer short circuits said first electrode layers and said at least one additional first electrode layer at end portions thereof.

11. A dielectric resonator device according to claim 1, wherein said at least one additional dielectric layer comprises a plurality of additional dielectric layers, said at least one additional thin film electrode comprises a plurality of additional thin film electrodes; said additional dielectric layers and additional thin film electrode layers being alternately laminated on said second thin film electrode layer; and said third thin film electrode layer short circuits said plurality of additional thin film electrodes at end portions thereof.

12. A dielectric resonator device according to claim 3, further comprising at least one additional dielectric layer and at least one additional thin film electrode layer laminated on said second thin film electrode layer, wherein said third thin film electrode layer short circuits said first thin film electrode layer, said second thin film electrode layer, and said at least one additional electrode layer at end portions thereof.

13. A dielectric resonator device according to claim 12, wherein said at least one additional dielectric layer comprises a plurality of additional dielectric layers, said at least one additional thin film electrode comprises a plurality of additional thin film electrodes; said additional dielectric layers and additional thin film electrode layers being alternately laminated on said second thin film electrode layer; and said third thin film electrode layer short circuits said plurality of additional thin film electrodes at end portions thereof.

14. A dielectric filter according to claim 8, further comprising at least one additional dielectric layer and at least one additional thin film electrode layer laminated on said second thin film electrode layer, wherein said third thin film electrode layer short circuits said first thin film electrode layer, said second thin film electrode layer, and said at least one additional electrode layer at end portions thereof.

15. A dielectric filter according to claim 14, wherein said at least one additional dielectric layer comprises a plurality of additional dielectric layers, said at least one additional thin film electrode comprises a plurality of additional thin film electrodes; said additional dielectric layers and additional thin film electrode layers being alternately laminated on said second thin film electrode layer; and said third thin film electrode layer short circuits said plurality of additional thin film electrodes at end portions thereof.

* * * * *